US011536467B2

(12) United States Patent
Wetzel et al.

(10) Patent No.: US 11,536,467 B2
(45) Date of Patent: Dec. 27, 2022

(54) CEILING MOUNTED EVAPORATOR BLOWER WITH SWING UP HINGED INSTALLATION

(71) Applicant: AIR INNOVATIONS, INC., North Syracuse, NY (US)

(72) Inventors: Michael Wetzel, Skaneateles, NY (US); Curtis Smith, Syracuse, NY (US)

(73) Assignee: AIR INNOVATIONS, INC., North Syracuse, NY (US)

( * ) Notice: Subject to any disclaimer, the term of this patent is extended or adjusted under 35 U.S.C. 154(b) by 278 days.

(21) Appl. No.: 17/035,469

(22) Filed: Sep. 28, 2020

(65) Prior Publication Data

US 2021/0095869 A1 Apr. 1, 2021

Related U.S. Application Data

(60) Provisional application No. 62/906,974, filed on Sep. 27, 2019.

(51) Int. Cl.
*F24F 1/0047* (2019.01)
*F24F 1/0007* (2019.01)

(52) U.S. Cl.
CPC ..... *F24F 1/0047* (2019.02); *F24F 1/0007* (2013.01)

(58) Field of Classification Search
CPC ..... F24F 1/0047; F24F 1/0007; F24F 13/20; F24F 13/32
See application file for complete search history.

(56) References Cited

U.S. PATENT DOCUMENTS 3,143,952 A * 8/1964 Simons ..... F24F 9/00 454/190
4,458,502 A * 7/1984 Adachi ..... F24F 1/0057 62/263
4,660,389 A * 4/1987 Kido ..... F24F 1/0063 62/298
5,749,779 A * 5/1998 Wilburn ..... B05B 16/60 454/67

(Continued)

FOREIGN PATENT DOCUMENTS

JP 11264605 A * 9/1999
WO WO-2018083791 A1 * 5/2018 ..... F24F 1/0047

(Continued)

OTHER PUBLICATIONS

Mitsubishi MLZ Ceiling Cassette Review, Sep. 30, 2015 (Year: 2018).*

*Primary Examiner* — Emmanuel E Duke
(74) *Attorney, Agent, or Firm* — Barclay Damon LLP

(57) ABSTRACT

An evaporator blower for air conditioning system that can be installed into a ceiling between existing joists. The system has a chassis dimensioned to fit between the pair of joists forms an air flow pathway through which air may be cooled by an evaporator housed in the chassis. A mounting flange is pivotally coupled to the chassis and has an opening through which the chassis can pivot between a first position below the mounting flange, and thus the ceiling, to a second position above the flange, so that the chassis is above the ceiling and between the pair of joists. A diffuser is attached to the mounting flange and provides supply and return air grilles that are in fluid communication with the air flow pathway of the chassis.

13 Claims, 10 Drawing Sheets

(56) References Cited

U.S. PATENT DOCUMENTS

| | | | | |
|---|---|---|---|---|
| 6,257,013 | B1 * | 7/2001 | Murray | F24F 13/32<br>62/302 |
| 9,574,815 | B2 * | 2/2017 | Ikeda | F24F 1/0022 |

FOREIGN PATENT DOCUMENTS

| | | | | |
|---|---|---|---|---|
| WO | WO-2018163285 | A1 * | 9/2018 | F24F 1/0007 |
| WO | WO-2018167848 | A1 * | 9/2018 | F24F 1/0047 |
| WO | WO-2018179136 | A1 * | 10/2018 | F24F 1/0047 |
| WO | WO-2019038798 | A1 * | 2/2019 | F24F 1/00 |

* cited by examiner

CEILING MOUNTED EVAPORATOR BLOWER WITH SWING UP HINGED INSTALLATION

CROSS-REFERENCE TO RELATED APPLICATIONS

The present application claims priority to U.S. Provisional App. No. 62/906,974, filed on Sep. 27, 2019, hereby incorporated by reference in its entirety.

BACKGROUND OF THE INVENTION

1. Field of the Invention

The present invention relates to air conditioning systems and, more specifically, to an evaporator blower for an air conditioning system that can be mounted in a ceiling between the joists.

2. Description of the Related Art

Conventional ceiling mounted air conditioning units must be installed upon construction of the building or require significant retrofitting as the evaporator blower that is installed in the ceiling is wider than the distance between ceiling joists. Installation of a ceiling mounted unit in an existing home or building can be prohibitively expensive, if installation is even possible, as the existing ceiling joists must be removed or relocated while ensuring that all building codes remain satisfied. As a result, there is need for an air conditioning system that can be easily installed in existing ceilings without having to modify or remove ceiling joists.

BRIEF SUMMARY OF THE INVENTION

The present invention is an air conditioning system that can be easily installed between a pair of joists in a building to install the air conditioning in the ceiling of a room. The air conditioning system has a chassis dimensioned to fit between the pair of joists and defines an air flow pathway through which air may be cooled by an evaporator housed in the chassis. A mounting flange is is pivotally coupled to the chassis and has an opening through which the chassis can pivot between a first position below the mounting flange, and thus the ceiling, to a second position above the flange, so that the chassis in above the ceiling and between the pair of joists. A diffuser is attached to the mounting flange and in fluid communication with the air flow pathway of the chassis. The mounting flange has a central opening through which the chassis can pivot between the first position and the second position. The chassis includes a supply air section, an evaporator, a fan assembly, and a return air section positioned in the air flow pathway. The diffuser includes a return air grille in communication with the return air section of the chassis and a supply air grille in communication with the supply air section of the chassis. The mounting flange includes a planar portion extending from the central opening. The planar portion of the mounting flange is dimensioned to be secured to the pair of joists. The chassis is pivotally coupled to the mounting flange by a first hinge positioned at a first end of the mounting flange. The chassis includes a series of brackets for coupling to the mounting flange when the chassis is in the second position. The diffuser is pivotally coupled to the mounting flange by a second hinge positioned at the first end of the mounting flange for movement between an open position and a closed position. The diffuser includes at least one locking tab positioned at an opposite end from the second hinge for coupling to the mounting flange when the diffuser is in the closed position. The central opening of the mounting flange is rectangular. The mounting flange includes a series of walls extending from at least three sides of the central opening and perpendicularly to the planar portion. The planar portion of the mounting flange includes a series of apertures positioned to allow the mounting flange to be coupled to the pair of joists if the pair of joists are either twelve of sixteen inches apart from each other so that the air conditioning system can be installed in either of the standard joist construction scenarios.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
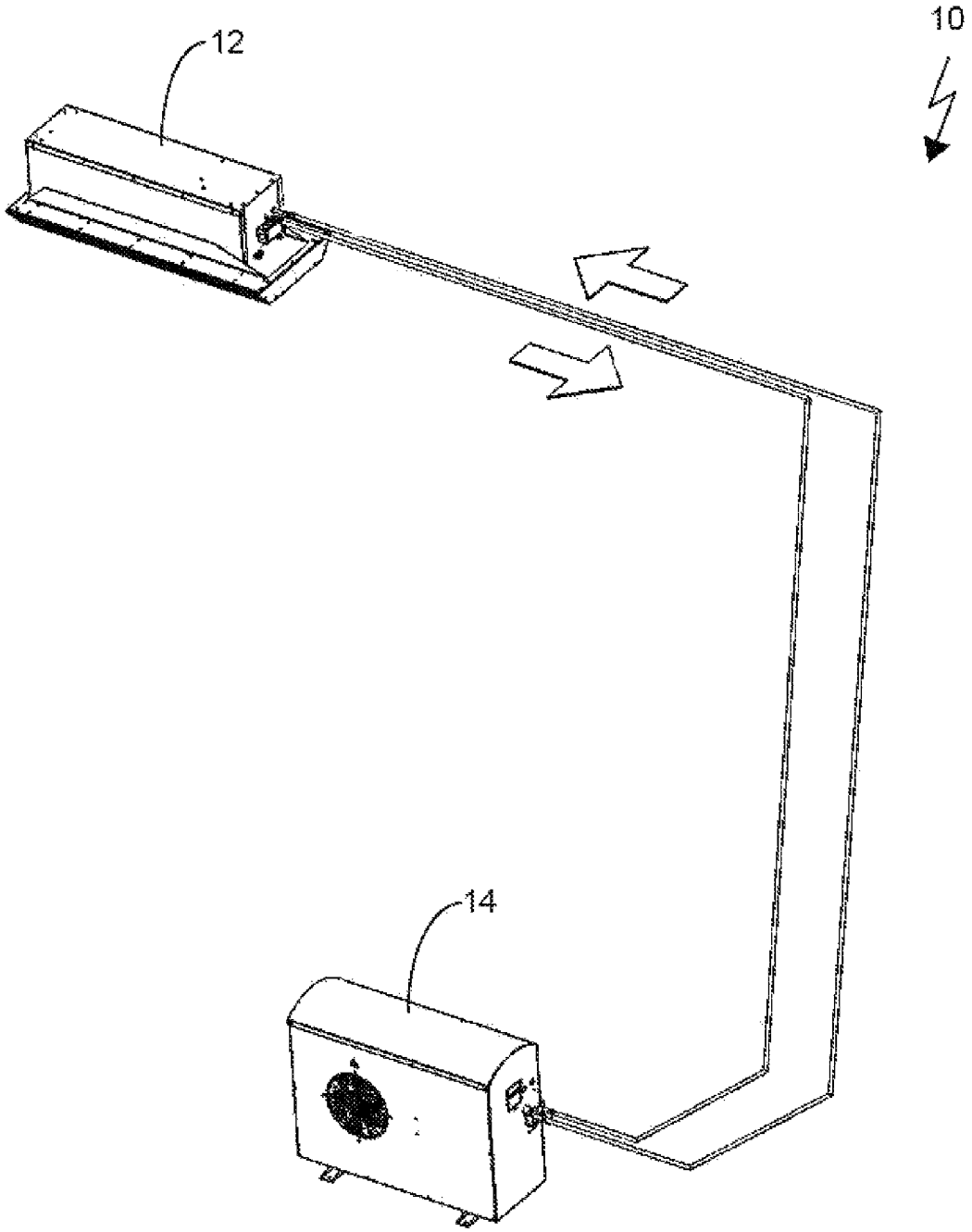
FIG. 1 is a schematic of an air conditioning system according to the present invention.
Figure 2:
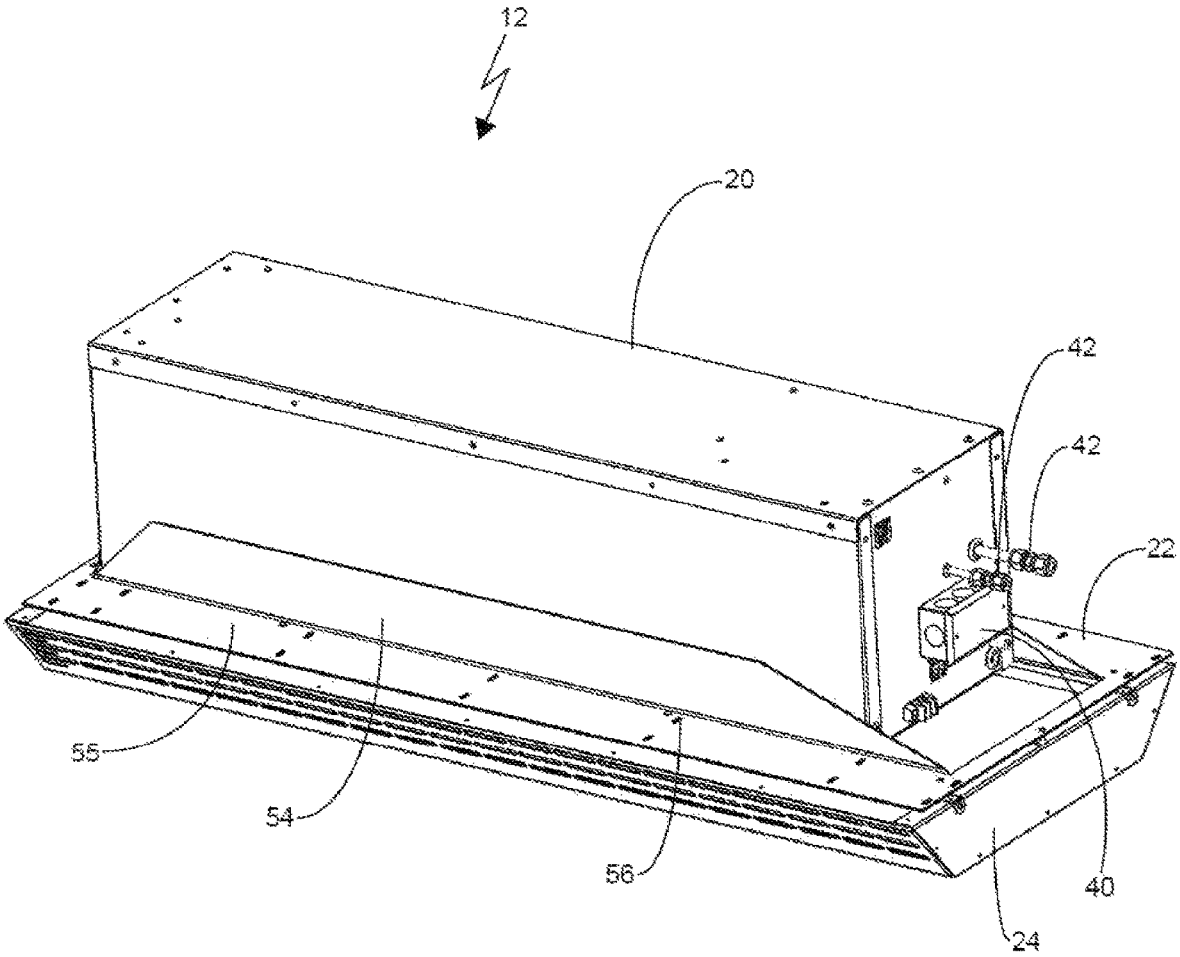
FIG. 2 is a perspective view of an evaporator blower according to the present invention.
Figure 3:
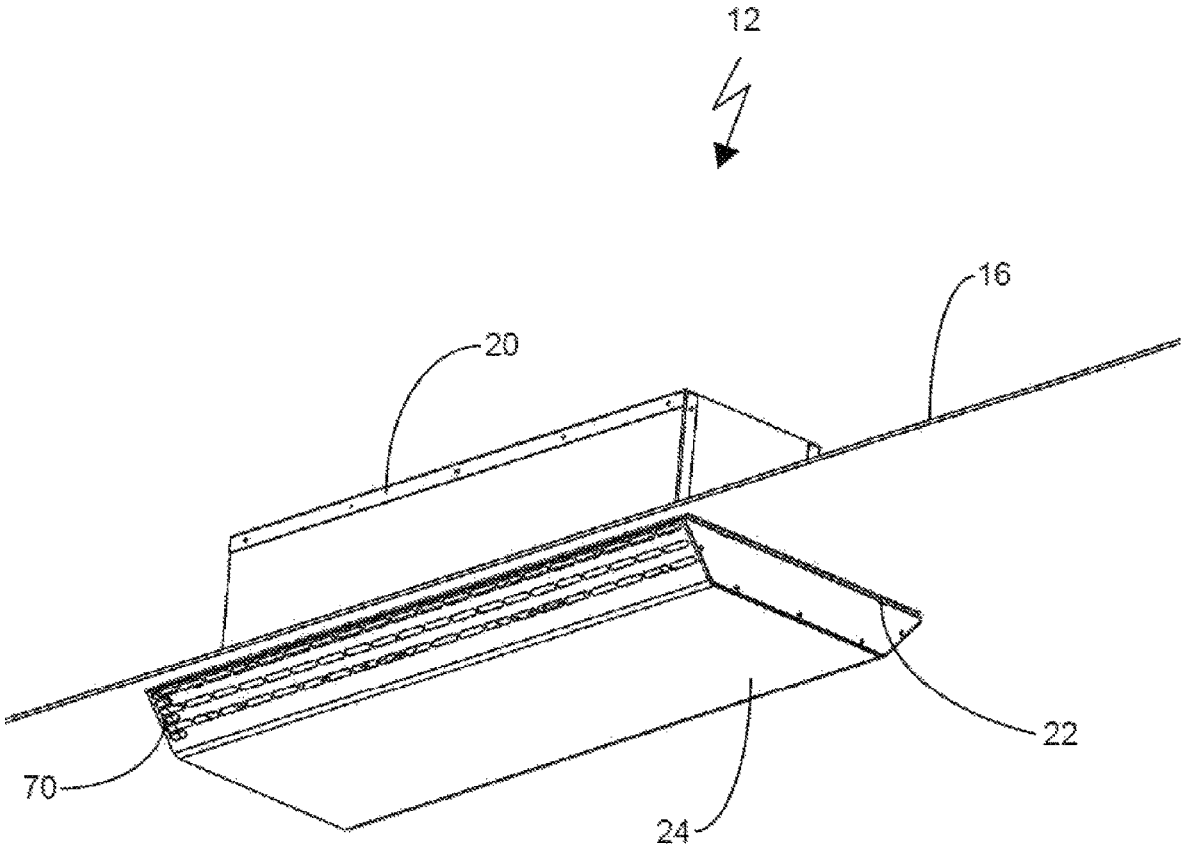
FIG. 3 is a perspective view of an evaporator blower according to the present invention installed in a ceiling

Referring to the figures, wherein like numeral refer to like parts throughout, there is seen in FIG. 1 air conditioning system 10 having a ceiling mounted evaporator blower 12 and a condensing unit 14 positioned remotely, such as a location outdoors. Evaporator blower 12 is configured for mounting in a ceiling 16 between adjacent joists 18, such as ceiling joists or the floor joists of a next story, which are either 12 inches or 14 inches apart depending on building codes and building construction. Referring to FIGS. 2 and 3, evaporator blower 12 comprises a fan-coil chassis 20 that extends above ceiling 16 when installed, a mounting flange 22 that secures evaporator blower 12 to ceiling 16 by coupling to adjacent ceiling joists 18, and a diffuser 24 that is coupled to mounting flange 22 to extend below ceiling 16.

Figure 4:
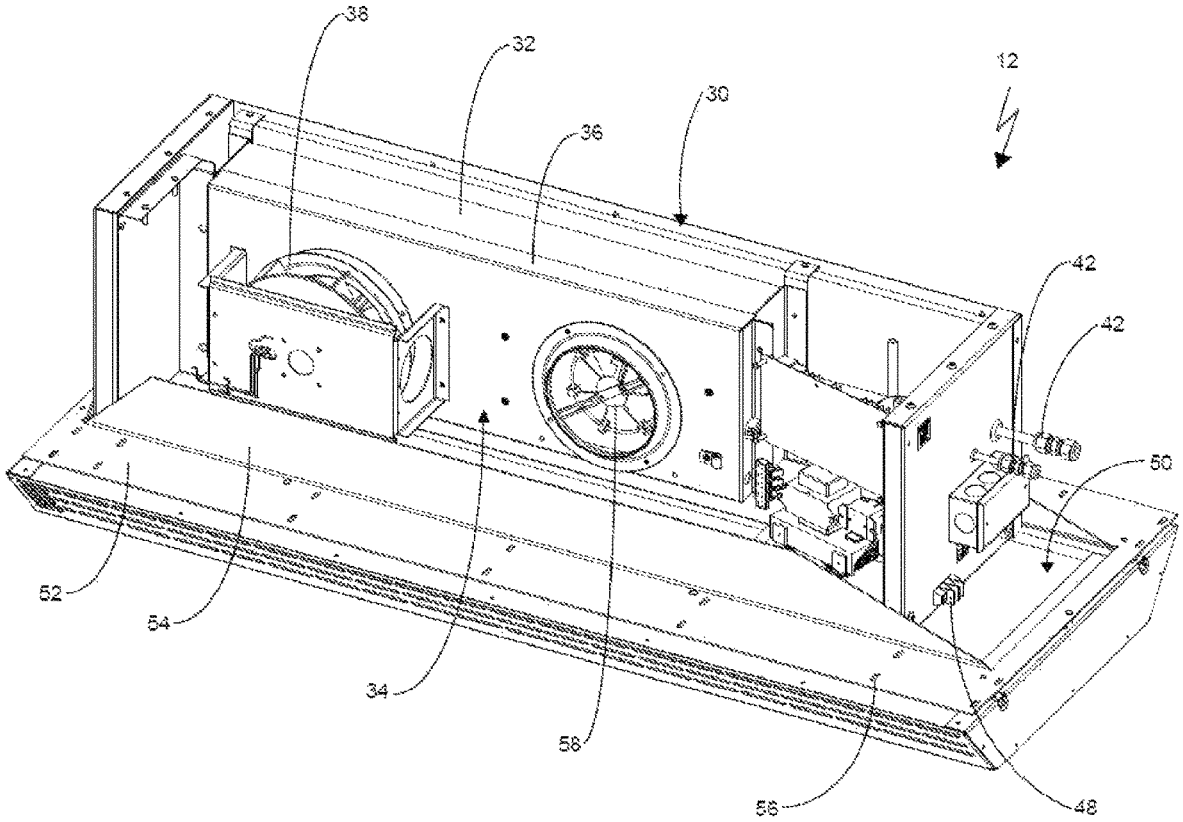
FIG. 4 is a perspective view of the inside of a chassis of an evaporator blower according to the present invention.
Figure 5:
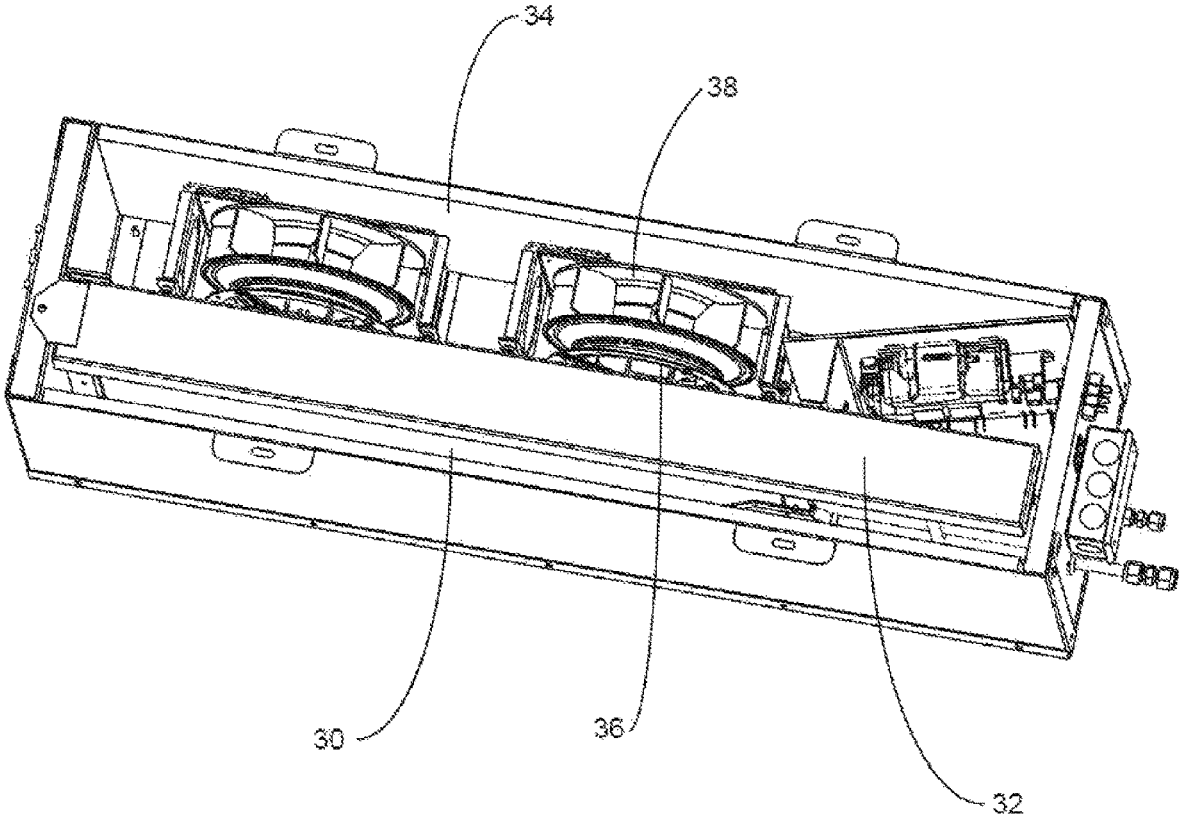
FIG. 5 is a perspective view of the inside of a chassis of an evaporator blower according to the present invention

Referring to FIGS. 4 and 5, chassis 20 defines an airflow pathway having a return air inlet 30 that withdraws air from the room to be cooled and a supply air outlet 34 that returns cooled air back to the room. Chassis 20 includes an evaporator coil assembly 32 positioned transversely across airflow pathway between return air inlet 30 and supply air outlet 34 and vertically in the space between joists 18. A fan shroud 36 supporting one or more motorized impeller fans 38 is positioned against evaporator coil assembly 32. Fans 38 draw air into the airflow pathway via return air inlet 30 for cooling by evaporator coil 32 and then return the cooled air back to the room via supply side outlet 34, thereby providing air conditioning for the room. A heater 58 may optionally be mounted within fan shroud 36 and airflow pathway to provide warm air (second fan 38 removed in FIG. 4 for clarity).

Figure 6:
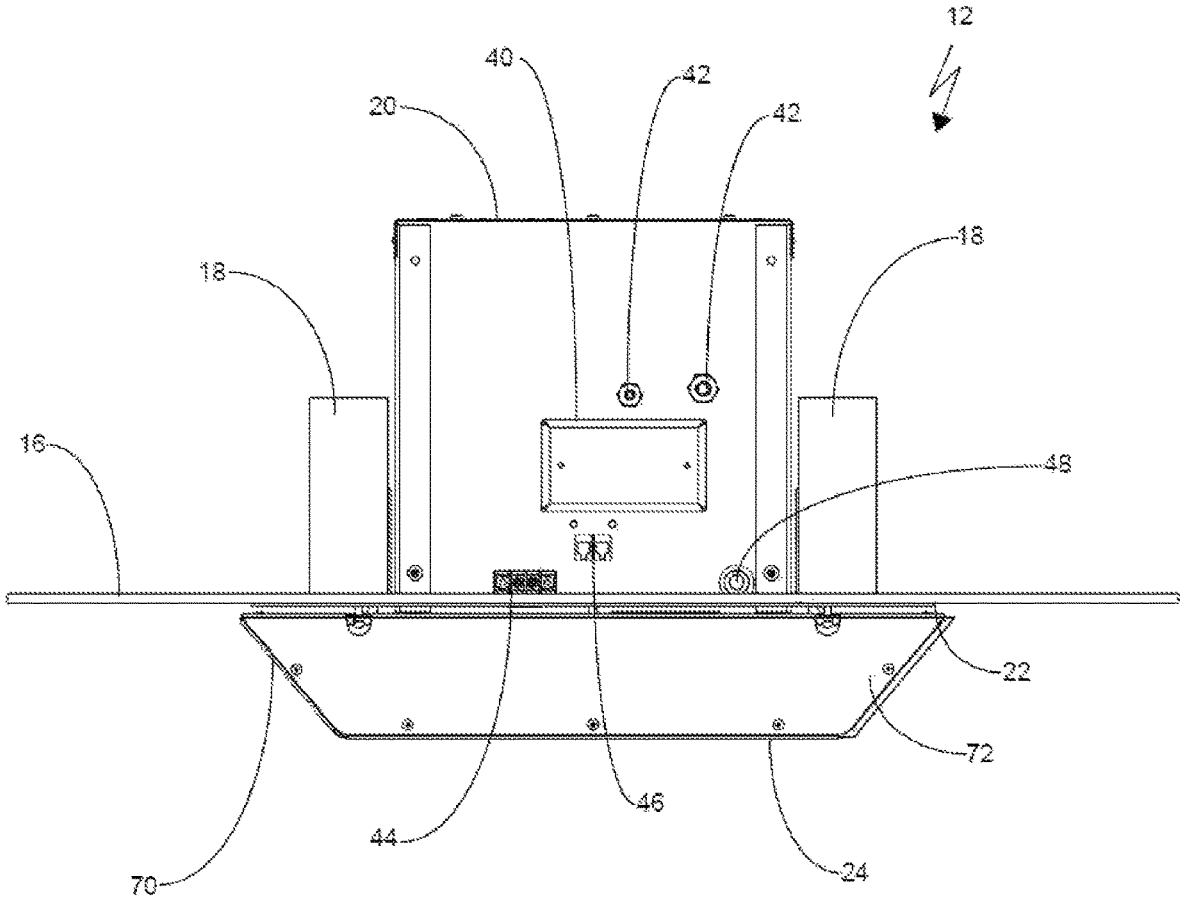
FIG. 6 is an end view of an evaporator blower according to the present invention installed in a ceiling.

As seen in FIG. 6, chassis 20 further comprises a junction box 40 for coupling to the power supply of the building, refrigerant piping 42 (such as standard suction line and liquid line) for coupling to condensing unit 14, a 24-volt connection 44, a remote sensor cable connection 46, and a drain 48. Chassis 20 is dimensioned to fit vertically and be pivotally within a rectangular central opening 50 of mounting flange 22, and thus has a width that is less than 12 inches so that chassis 20 can fit between adjacent ceiling joists 18.

Figure 7:
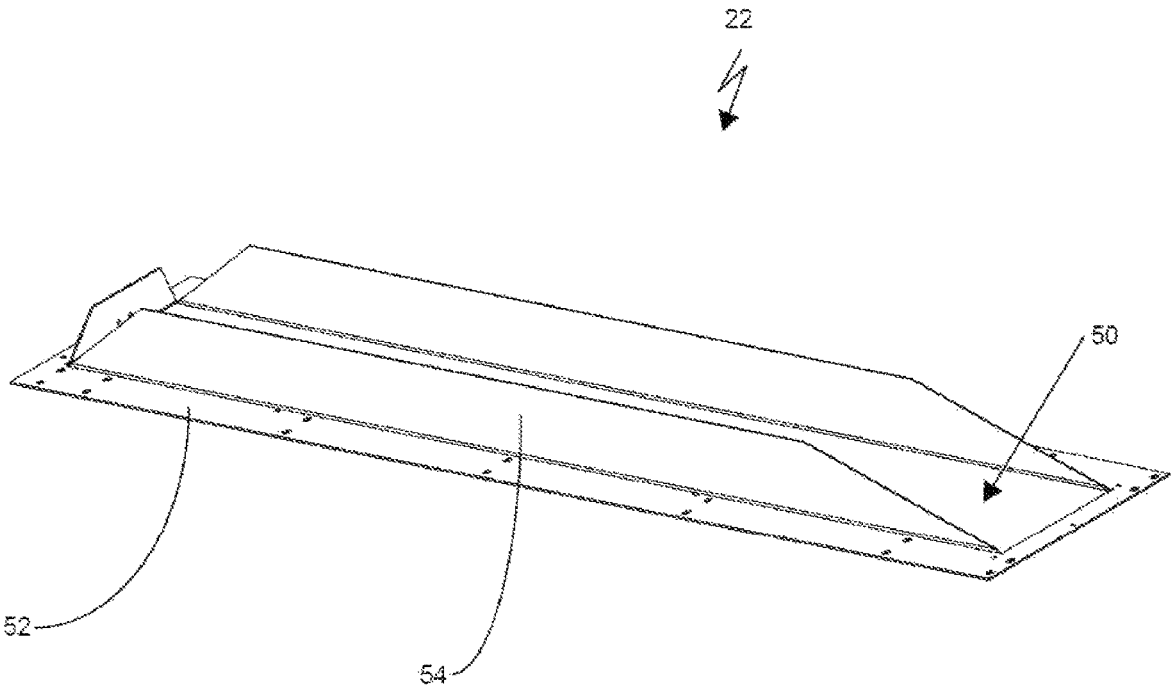
FIG. 7 is a perspective view of a mounting flange according to the present invention.

Referring to FIG. 7, mounting flange 22 comprises a planar portion 52 extending horizontally outwardly from rectangular central opening 50. Three sides of central opening 50 include vertical walls 54 extending upwardly from the one of the short sides and both of the long sides of opening 50. Mounting flange 22 is dimensioned for attachment to standard joists (12 or 16 inch) and thus may include one or more sets of apertures 56 extending through planar portion 52 so that mounting flange 22 can be coupled to joists 18, such as via a series of wood screws positioned in apertures 56.

Figure 8:
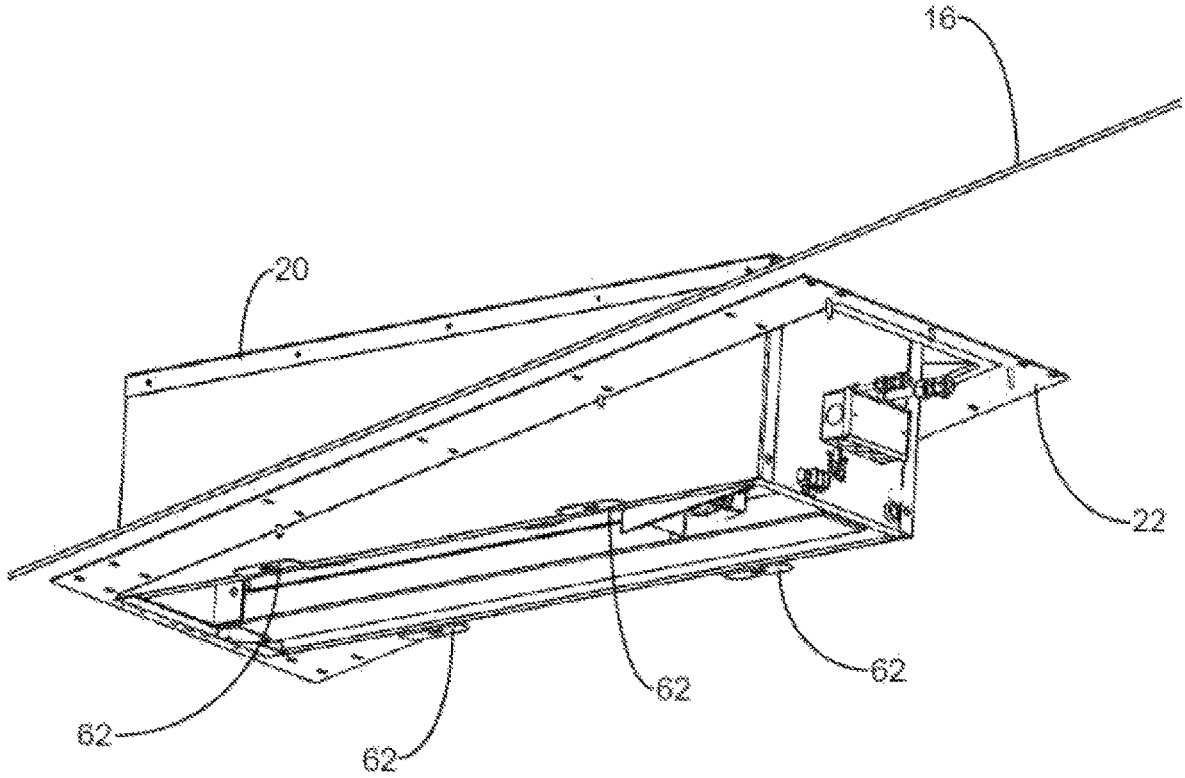
FIG. 8 is a perspective view of a chassis partially installed into a mounting flange according to the present invention.
Figure 9:
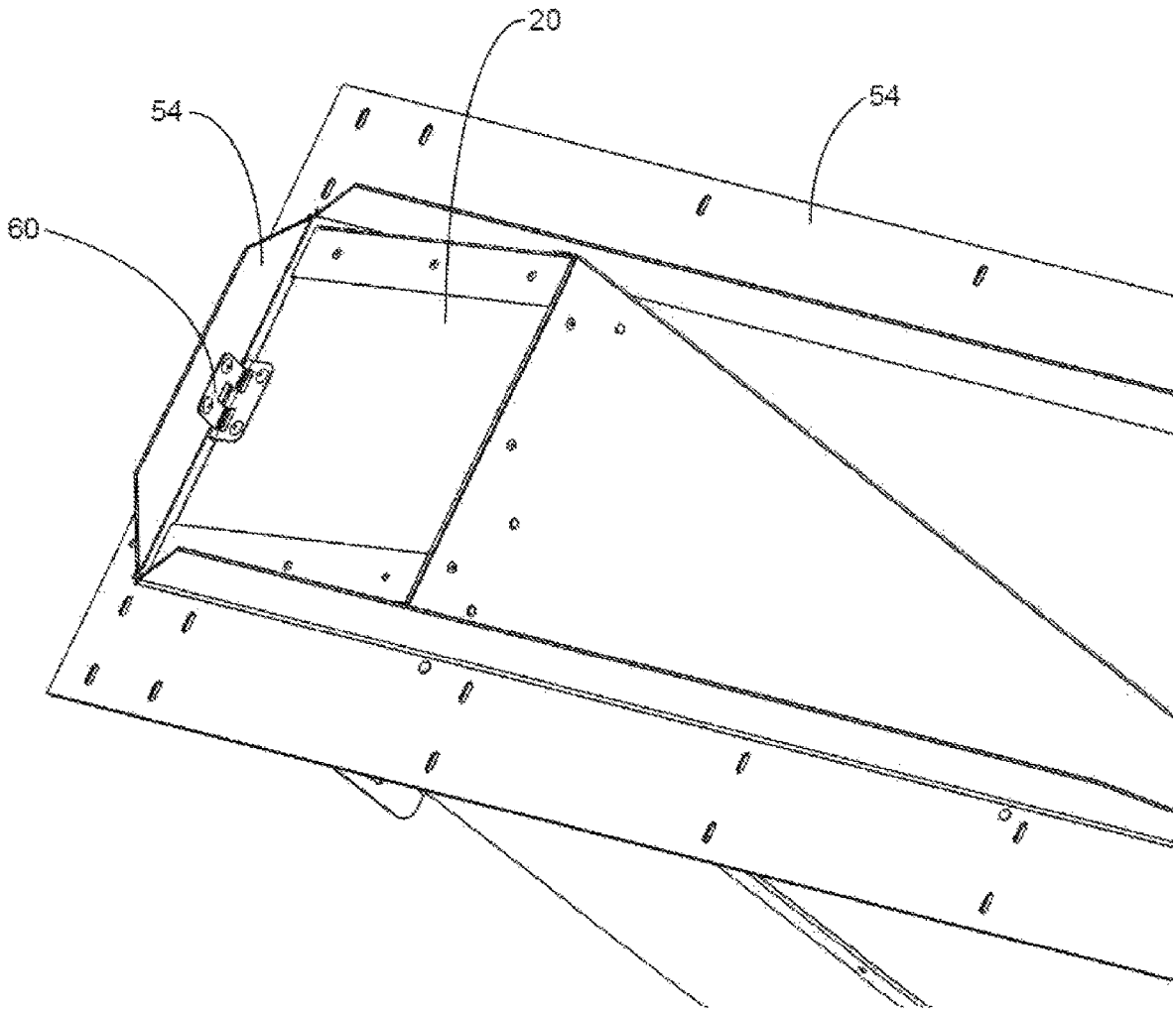
FIG. 9 is a perspective view of a chassis partially installed into a mounting flange according to the present invention.

Referring to FIGS. 8 and 9, chassis 20 is pivotally coupled to mounting flange 22 via a lift-off hinge 60 coupled to chassis 20 and mounting flange 22 along an intermediation portion of one of the short sides of rectangular opening 50. Hinge 60 allows chassis 20 to pivot between a first position, where chassis 20 extends downwardly below ceiling 16 and mounting flange 22, and a second position, where the bottom of chassis 20 is aligned horizontally with mounting flange 22 so that the chassis 20 extends above ceiling 16 between joists 18, as seen in FIG. 4. Chassis 20 may thus be easily installed by attaching chassis 20 to mounting flange 22 with lift-off hinge 60, and then swinging chassis 20 about hinge 60 into the second position. Mounting brackets 62 that extend horizontally from the sides of the lower edge of chassis 20 may be used to securely bolt chassis 20 to mounting flange 22 to retain chassis 20 in the second position. Conversely, chassis 20 may be unbolted and pivoted about hinge 60 from the second position back to the first position for each maintenance or repair without having to completely remove evaporator blower 12 from ceiling 16.

Figure 10:
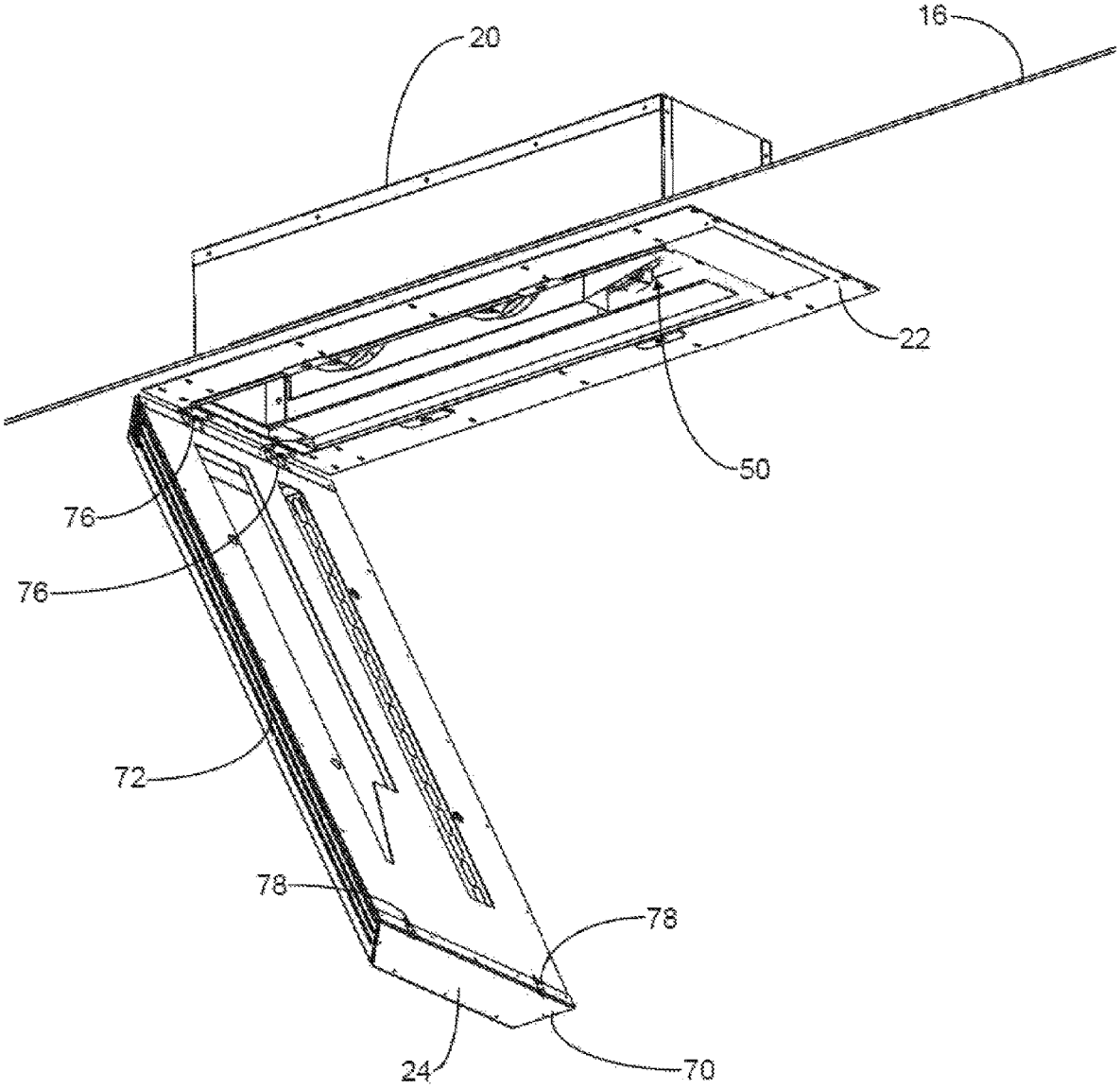
FIG. 10 is a perspective view of a grill assembly coupled to a mounting flange according to the present invention.

Referring to FIG. 10, diffuser 24 comprises a return air side grille 70 on one side and a supply air side grille 72 on an opposing side. Return air side grille 70 and supply air side grille 72 are aligned with and in-fluid communication with return air inlet 30 and supply air outlet 34 of chassis 20, respectively, when diffuser 24 is installed. Diffuser 24 is coupled to mounting flange 22 at one end via a lift-off hinge 76. Diffuser 24 may thus be easily coupled to mounting flange 22 by hinge 76, pivoted upwardly into engagement with mounting flange 22, and then secured in place with a pair of locking tabs 78 positioned at the opposing end of diffuser 24 from hinge 74 to complete assembly of evaporator blower 12. Diffuser 24 is preferably manufactured from anodized aluminum so that diffuser 24 can be painted to match ceiling or otherwise as desired.

What is claimed is:

1. An air conditioning system, comprising:

a chassis dimensioned to fit between a pair of joists and defining an air flow pathway through which air may be cooled by an evaporator housed in the chassis;

a mounting flange pivotally coupled to the chassis so that the chassis can pivot between a first position below the mounting flange to a second position above the flange; and a diffuser attached to the mounting flange and in fluid communication with the air flow pathway of the chassis.

2. The system of claim 1, wherein the mounting flange includes a central opening through which the chassis can pivot between the first position and the second position.

3. The system of claim 2, wherein the chassis including a supply air section, a condenser, a fan assembly, and a return air section positioned in the air flow pathway.

4. The system of claim 3, wherein the diffuser includes a return air grille in communication with the return air section of the chassis and a supply air grille in communication with the supply air section of the chassis.

5. The system of claim 4, wherein the mounting flange includes a planar portion extending from the central opening.

6. The system of claim 5, wherein the planar portion of the mounting flange is dimensioned to be secured to the pair of joists.

7. The system of claim 6, wherein the chassis is pivotally coupled to the mounting flange by a first hinge positioned at a first end of the mounting flange.

8. The system of claim 7, wherein the chassis includes a series of brackets for coupling to the mounting flange when the chassis is in the second position.

9. The system of claim 8, wherein the diffuser is pivotally coupled to the mounting flange by a second hinge positioned at the first end of the mounting flange for movement between an open position and a closed position.

10. The system of claim 9, wherein the diffuser includes at least one locking tab positioned at an opposite end from the second hinge for coupling to the mounting flange when the diffuser is in the closed position.

11. The system of claim 10, wherein the central opening of the mounting flange is rectangular.

12. The system of claim 11, wherein the mounting flange includes a series of walls extending from at least three sides of the central opening and perpendicularly to the planar portion.

13. The system of claim 12, wherein the planar portion of the mounting flange includes a series of apertures positioned to allow the mounting flange to be coupled to the pair of joists if the pair of joists are either twelve of sixteen inches apart from each other.

* * * * *